United States Patent [19]

Handa et al.

[11] Patent Number: 4,786,288

[45] Date of Patent: Nov. 22, 1988

[54] FABRIC TREATING METHOD TO GIVE SHARP COLORED PATTERNS

[75] Inventors: Nobuyoshi Handa; Yutaka Masuda; Teruo Nakamura, all of Otsu, Japan

[73] Assignee: Toray Industries Incorporated, Japan

[21] Appl. No.: 171,156

[22] Filed: Mar. 16, 1988

Related U.S. Application Data

[63] Continuation of Ser. No. 887,134, Jul. 17, 1986, abandoned.

[30] Foreign Application Priority Data

| | | | |
|---|---|---|---|
| Oct. 7, 1983 | [JP] | Japan | 58-18689 |
| Jun. 18, 1984 | [JP] | Japan | 59-123823 |
| Oct. 1, 1984 | [JP] | Japan | 59-204103 |

[51] Int. Cl.[4] ..... B41M 1/30; D06P 1/52; B41J 3/04

[52] U.S. Cl. ..... 8/495; 8/602; 8/606; 8/618; 106/20; 427/150; 427/299; 427/301

[58] Field of Search ..... 8/495; 106/20

[56] References Cited

U.S. PATENT DOCUMENTS

| | | | |
|---|---|---|---|
| 3,546,008 | 12/1970 | Shields et al. | 428/395 |
| 4,101,273 | 7/1978 | Matsuba et al. | 8/609 |
| 4,229,174 | 10/1980 | Boerzel et al. | 8/588 |
| 4,330,293 | 5/1982 | Lindemann | 8/495 |
| 4,554,555 | 11/1985 | Aruga et al. | 106/20 |
| 4,693,728 | 9/1987 | Clare et al. | 8/561 |
| 4,702,742 | 10/1987 | Iwata et al. | 8/495 |

FOREIGN PATENT DOCUMENTS

| | | |
|---|---|---|
| 1571870 | of 1970 | Fed. Rep. of Germany . |
| 49-075885 | 7/1974 | Japan . |
| 49-110986 | 10/1974 | Japan . |
| 54-018975 | 2/1979 | Japan . |
| 1587930 | 4/1981 | United Kingdom . |

*Primary Examiner*—A. Lionel Clingman

*Attorney, Agent, or Firm*—Scully, Scott, Murphy & Presser

[57] ABSTRACT

The present invention relates to an ink applying method for obtaining desired sharp patterns while preventing bleeding and an ink composition therefor, in applying a low viscosity liquid to a polymer product such as fabric in the form of droplets according to the ink jet or spray process.

As a treating solution there is used a solution incorporating a water-soluble or water-dispersible material which contains —$OSO_3M$ group or —$SO_3M$ group as a hydrophilic group in which M is a monovalent metal, ammonium or amine, and a fiber structure is pretreated with a chemical for coagulating the said hydrophilic group, whereby good bleeding preventing effect and deep shading effect even against markedly bleeding fiber structures such as thin fabrics as well as level dyeing effect of colored portions can be attained without impairing the injection characteristic. Sharp patterns equal or superior to conventional prints can be obtained.

3 Claims, No Drawings

FABRIC TREATING METHOD TO GIVE SHARP COLORED PATTERNS

This is a continuation of application Ser. No. 887,134 filed July 17, 1986 now abandoned.

BACKGROUND OF THE INVENTION

The present invention relates to a method of applying a treating agent such as a coloring solution to polymer products and a composition used for same. Particularly, it is concerned with a dyeing process for obtaining bleeding-prevented sharp and clear print patterns on sheet-like substrates such as fabrics by the ink jet or spray method, as well as an ink composition used for same.

Screen printing, roller printing, rotary printing and transfer printing methods have heretofore been adopted generally as textile printing methods. However, all of these conventional textile printing methods require a plate-making process and much labor and preparation period before goods production. Besides, notwithstanding the today's situation of diversified fashions and desire for multi-variety, small lot production, the above concentional textile printing methods are markedly lacking in instant printing capability. To remedy this inconvenience, developments are now under way in the field of recording or printing on paper. Above all, an ink jet recording process capable of printing without using plates is beginning to attract attention. When this process, mainly using paper, is applied to textiles, there occurs the problem of bleeding as a major problem. Textiles are not so water-absorbable as paper and have directionality and voids, so ink bleeding occurs to a large extent, making it difficult to obtain clear patterns.

To prevent such bleeding in fabrics, British Pat. No. 1,587,930 proposes a method in which natural carbohydrates (e.g. flour or starch derivative, alginate) are mixed in ink components, and fabric is pretreated with a coagulating agent (e.g. aluminum sulfate, sodium borate, borax).

Further, in U.S. Pat. No. 4,330,293 there is proposed a method in which a synthetic polymer containing carboxylic acid is mixed into ink and fabric is pretreated with an alkali compound.

However, according to the present inventors' study, the above methods involve the following drawbacks (1) For thin fabrics, aside from thick fabrics such as carpets, bleeding cannot be prevented to a satisfactory extent.

(2) Although it is preferable that the ink viscosity be low in a high speed ink jet, it is impossible to obtain a satisfactory effect because only small amounts of natural carbohydrate and polycarboxylic acid can be incorporated in ink components from the standpoint of injection characteristic.

(3) The above known compounds cannot be used. because they exhibit a coagulating action against a water dispersion type ink such as a disperse dyestuff. Also against water-soluble dyestuffs, those compounds are apt to form gels.

(4) The pretreatment with an alkali compound causes a change in quality or decrease of tenacity of natural fibers such as wool and silk as well as synthetic fibers such as acrylic fibers.

Further, in Japanese Patent Laid Open No. 106989/1984 there is proposed a method in which a recording medium is pretreated with a metallic salt and a cationic substance and then an ink which comprises a water-soluble dyestuff is applied thereto to improve the resistance to water and to light. However, this proposed ink jet method is applied to paper, and if it is applied to fabric, a hydrophilic group ($-SO_3Na$) of the water-soluble dyestuff will be substituted by a metal, e.g. Ca, into $[(-SO_3)_2Ca]$, resulting in deterioration of the water solubility, decrease of functional groups substantially bonded to the fabric and a marked reduction of dyeing affinity.

SUMMARY OF THE INVENTION

The present invention resides in a polymer product treating method characterized in that a treating solution containing at least one water-soluble or water-dispersible hydrophilic substance (A) having a hydrophilic group represented by the formula $-OSO_3M$ or $-SO_3M$ (M being a monovalent metal, ammonium or amine group) water and a treating agent is applied to a polymer product pretreated with a substance (B) for coagulating the substance (A), as well as said treating solution.

According to the present invention, for example in the case of an ink jet process, there can be obtained sharp and clear print patterns prevented from bleeding without deterioration of dyeing property, in good ink injection characteristic for all kinds of fabrics, including thin fabrics.

DETAILED DESCRIPTION OF THE PREFERRED EMBODIMENT

The effect of the present invention resides in that even if a treating solution of low viscosity which bleeds easily is used, it is possible to prevent its bleeding effectively. The treating method which permits such effect of the present invention to be exhibited easily is an ink jet or spray process in which a treating solution is applied to a fabric in the form of droplets. Typical treating solution to which is applied the method of the present invention is a coloring solution. But, the application of the present invention is not limited thereto; the method of the invention is also applicable to treating solutions for imparting colorless functional chemicals (e.g. fluorescent whitening agent, reactant, adhesive).

The present invention will be described below in more detail mainly about dyeing using droplets such as an ink jet dyeing.

The ink jet process is a printing process in which non-contact recording and printing are effected by controlling, using a computer, the ink which is injected from a nozzle of 30 to 500$\mu$. It is applied to dyeing for forming patterns on substrates such as fabrics. The ink jet process includes a number of devised processes, which are classified into three major processes according to how to produce ink droplets. The present invention is applicable to any process, including those just mentioned. The first process is a pressure pulse type process (on demand type) in which ink droplets are ejected on demand from an orifice by the action of a piezoelectric element alone. The second process is a pressure fibration type process in which pressurized ink is injected as a jet from a fine hole and controlled by applying electrical charge while splitting it into fine droplets by vibration. The third process is an electrostatic acceleration type process in which ink is drawn from a nozzle by an electrostatic attraction, inlike the second process in which pressurized ink is injected from a fine hole. Also to bubble jet and slit jet processes, the present invention is applicable.

Where the present invention is applied to the spray process, the spray process may be any of one-fluid type, two-fluid type and electrostatic spray type.

The ink jet process and the spray process are applicable to both printing and solid dyeing. The ink jet process which is easier to attain uniformness of droplets, is most preferable.

It is the key point of the present invention to prevent bleeding by coagulating ink on a substrate. to this end, it is necessary to prepare an ink composition which contains a specific coagulatable compound, and pretreat a substrate with a specific coagulant to cause the coagulation. The specific coagulatable compound referred to herein is a water-soluble or water-dispersible compound having —$SO_3M$ group.

The coagulation referred to herein means that a low viscosity ink is rendered high in viscosity and/or wraps therein a treating agent such as dyestuff under the action of coagulation or gelation induced by ion reaction and is thereby coagulated to prevent bleeding.

The water-soluble or water-dispersible compound having —$OSO_3M$ or —$SO_3M$ group used in the present invention is a compound capable of being coagulated while wrapping therein a functional chemical or treating agent such as a coloring agent in an instant with a coagulating agent which has been applied through pretreatment to a material to be treated. Two typical examples may be mentioned, one being water-soluble or water-dispersible polymers having —$SO_3M$ group or —$SO_3M$ group and the other being compounds having —$OSO_3M$ group or —$SO_3M$ group and ranging in molecular weight from 350 to less than 2,000. The second compounds are effective as a material having a dispersing function, for example as a dispersing agent, for dispersing in water substantially water-insoluble chemicals such as a coloring agent. The other materials than the above dispersible polymers and dispersant are not found to have the function of coagulating while wrapping therein a treating agent.

As the first water-soluble or water-dispersible polymers having —$SO_3M$ group are preferred those ranging in molecular weight from 2,000 to 100,000. Those having a molecular weight less than 2,000 are weak in coagulating power except the second dispersant, and those having a molecular weight larger than 100,000 involve problems that ink becomes unstable due to coagulation and the injection characteristic of ink is deteriorated by thickening action. Therefore, a specially preferred range of molecular weight is from 3,000 to 40,000. Examples of such polymers include polyester resins or polyamide resins copolymerized with sulfoisophthalic acid, etc., or polyacrylic resins copolymerized with a vinyl monomer having sulfonic acid group. In these polymers, the resins per se have a water-soluble or water-dispersible hydrophilic property. Particularly, polyester resins are preferred in such aspects as adhesion, stability in the presence of dyestuff, gelating ability and touch. Above all, water-dispersible polyester resins do not impair the injection characteristic of ink because they do not cause an increase of viscosity even when incorporated in ink, and thus are preferable.

Water-soluble or water-dispersible polyester resins are prepared using dicarboxylic acids such as terephthalic acid and isophthalic acid as acid component, diols such as ethylene glycol and butylene glycol as alcohol component, and bifunctional monomers having —$SO_3M$ group as a third component. The bifunctional monomer component can be dicarboxylic acid (or its derivatives) having —$SO_3M$ group or diol having —$SO_3M$ group. Particularly preferred bifunctional monomers are sodium salts of sulfoisophthalic acid, sulfoterephthalic acid, sulfophthalic acid and 4-sulfonaphthalene-2,7-dicarboxylic acid. Very suitable monomers are 5-sodiosulfoisophthalic acid and its derivatives, e.g. sodiosulfodimethylisophthalate.

Where bifunctional monomer component having —$SO_3M$ group is an acid or a derivative thereof, polyester must contain at least about 6 mol % based on the total acid content of monomer, and where the bifunctional monomer component is a diol, polyester must contain at least 6 mol % based on the total diol content of monomer. The production of such polyesters is well known as disclosed, for example, in Japanese Patent Publication No. 40873/1972 (corresponding to U.S. Pat. No. 3,546,008).

Also as to polyamides, water-soluble copolyamides can be obtained by the copolymerization of monomers such as 5-sodium sulfoisophthalic acid.

The quantity of —$SO_3M$ group in the water-soluble or water-dispersible polymer used in the invention is not specially limited, but it is at least a quantity required for imparting water-solubility or water-dispersibility to the polymer. If the quantity of —$SO_3M$ group is excess, it becomes difficult to effect the coagulation with a coagulating agent. According to a generally preferred range, the polymer contains 150 to 1,500 millimol equivalent of —$SO_3M$ groups per kilogram thereof.

Another typical water-soluble or water-dispersible material which may be used in the present invention is a dispersant having —$OSO_3M$ group or —$SO_3M$ group. Preferably, this material is used when the treating agent such as a coloring agent is substantially water-insoluble and must be dispersed using a dispersing agent. As the dispersing agent, it is necessary to use one capable of dispersing the treating agent effectively and being easily coagulated with the coagulating material. Where the treating agent is a water-insoluble dye or pigment, it is preferable to use such dispersing agents as sulfates or sulfonates having not less than three aromatic rings as hydrophobic groups per —$OSO_3M$ group or —$SO_3M$ group as a hydrophilic group. The aromatic ring referred to herein indicates benzene ring or naphthalene ring. One naphthalene ring is counted as two aromatic rings.

Typical examples of such dispersing agent are those represented by the following general formula:

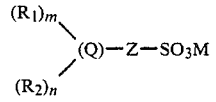

where,

Q: benzene ring or naphthalene ring $R_1$: aromatic ring-containing group, e.g. arylalkyl m: integer of 2 to 5

$R_2$: non-aromatic group, e.g. lower alkyl, halogen n: integer of 0 to 3

Z: divalent alkylene ether or a derivative thereof

M: ammonia, amine, monovalent metal

Particularly, those represented by the following general formula are preferred:

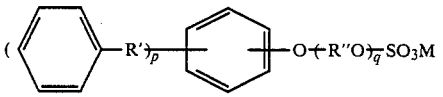
wherein R′ an allkylene g roup having 1 to 2 carbon atoms, R″ is an alkylene group having 2 or 3 carbon atoms, p is an integer of 2 or 3 and q is an integer of 2 to 30.
The following are mentioned as typical examples of dispersnats represented by the above general formulae:
(1)
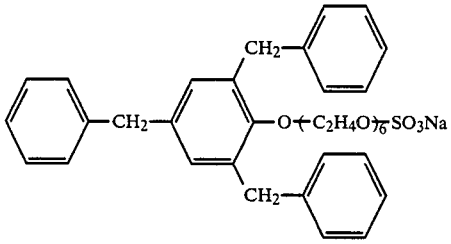
(2)
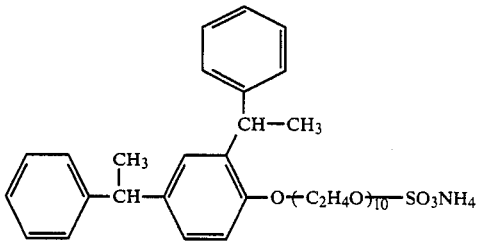
(3)
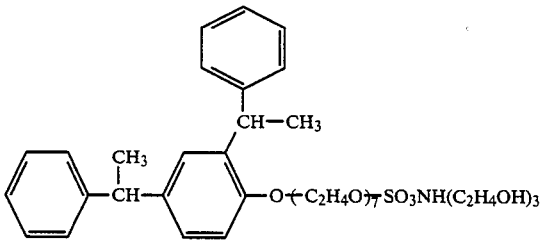
(4)
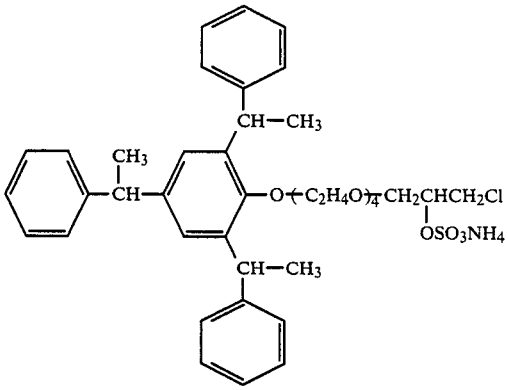
(5)
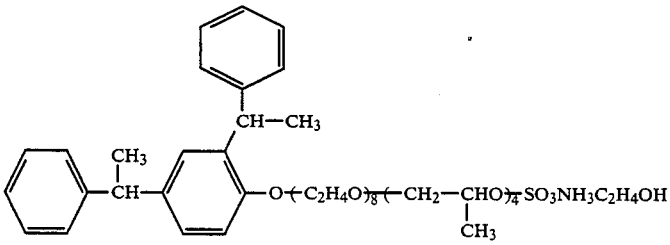
(6)
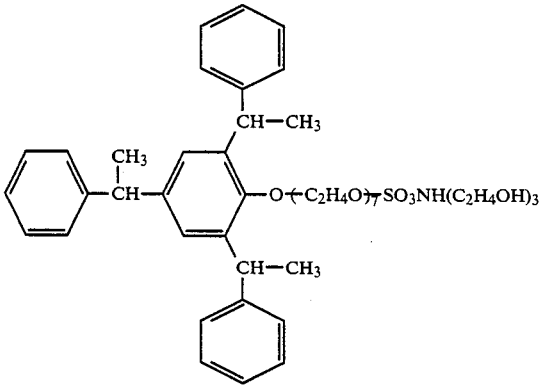

-continued (7)

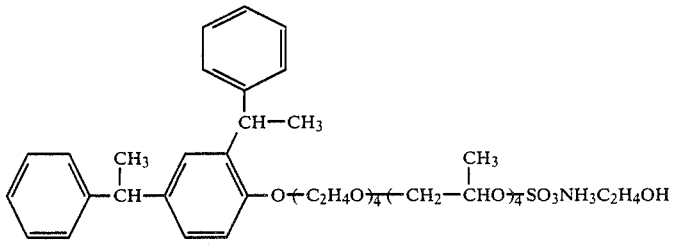

(8)

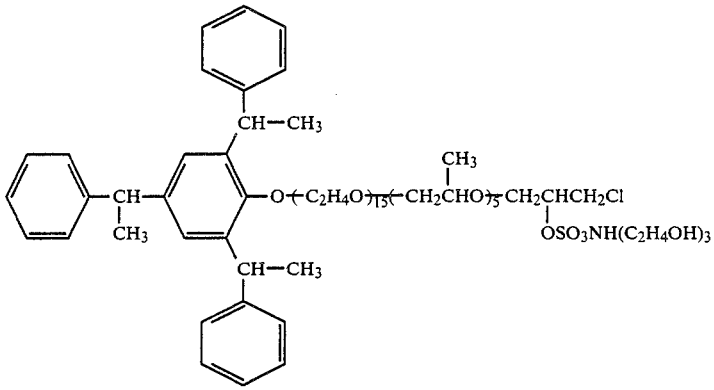

(9)

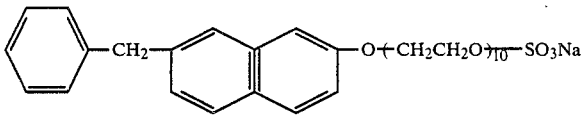

(10)

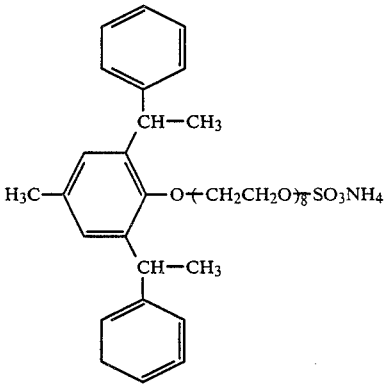

The M in the —$SO_3M$ group referred to herein means a monovalent cation, examples of which include Na, K, Li, $NH_4$ and amines such as monoethanolamine and triethanolamine.

The material containing —$OSO_3M$ or —$SO_3M$ group may be used alone or in combination.

As to the material (B) for coagulating —$SO_3M$ or —$SO_3M$ group-containing material (A) used in the present invention, preferred examples are water-soluble inorganic metal salts, organocarboxylic acid metal salts, polyamines, amine salts and polyammonium salts, in which metals are mono- or polyvalent metals, preferably Na, K, Zn, Mg, Ca, Ba and Al. Preferred salts are halides, nitrates and acetates. Among these, preferred metals which exhibit a high coagulating property are Ba, Ca and K, and halides, especially chlorides, thereof are preferred.

Organic nitrogen-containing cationic compounds such as polyamines are also employable as the coagulating material.

As examples of such compounds are mentioned various amine salts, quaternary ammonium salt type cationic surfactants, quaternary ammonium salt polymers and polyamines.

Examples of amines include higher alkylamine salts and amide type amine salts obtained from fatty acids and lower amines. Examples of quaternary ammonium salts include those obtained from higher alkylamines such as alkyltrimethylammonium salt and alkyldimethylbenzylammonium salt, and quaternary ammonium salts obtained from fatty acids and lower amines.

As examples of quaternary ammonium salt type polymers are mentioned polymers, or copolymers with other monomers, of quaternary ammonium salt-containing vinyl monomers represented by the following formulae (1) and (2):

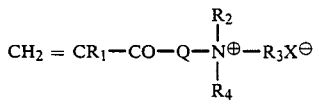

(1)

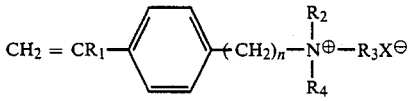

(2)

where $R_1$: H or lower alkyl having 1 to 6 carbon atoms $R_2$–$R_4$: lower alkyl having 1 to 6 carbon atoms Q: divalent substituent group $X^{\ominus}$: anion n: integer of 0 to 2

As examples of polyamines are mentioned polyethyleneimines, products obtained by the reaction of polyfunctional amines of low molecular weight with polyfunctional compounds to amino group such as epihalohydrin, and polyamidepolyamines.

Effective cationic pretreating agents are polyamines and polyammonium salts. Water-soluble cationic compounds are preferred.

According to the method of the present invention, a substrate such as fabric is pretreated with at least one of the materials exemplified above as the material (B).

The concentration of the pretreating agent is in the range of 0.1 to 30 wt. %, preferably 0.5 to 10 wt. %, based on the weight of polymer product, although it differs depending on the substrate used and the degree of bleeding. As the application method, there may be adopted any of dipping, padding, coating, spray and ink jet methods. The polymer product thus pretreated may be dry or wet.

The following description is now provided about coloring ink compositions where the treating solution is a coloring agent.

As ink compositions for attaining the foregoing prevention of bleeding are mentioned two kinds of compositions, one being of a water-insoluble dyestuff or pigment and the other of a water-soluble dyestuff. As a water-insoluble dyestuff or pigment composition is preferred an ink composition which contains a water-insoluble dyestuff or pigment, a dispersing agent having —$OSO_3M$ or —$SO_3M$ group as a hydrophilic group and three or more aromatic rings as hydrophobic groups for each said hydrophilic group, and a water-soluble or water-dispersible polymer which contains —$SO_3M$ group. It is preferable that a water-insoluble dyestuff or pigment be dispersed with a dispersing agent containing —$OSO_3M$ or $SO_3M$ to coagulate ink and then a water-soluble or water-dispersible polymer having —$SO_3M$ group be incorporated therein to enhance the coagulation of ink if necessary.

Even where the dispersion is made using a dispersing agent, e.g. a nonionic dispersing agent, other than the one used in the present invention, it is possible to prevent bleeding by adding the polymer used in the present invention. The content in ink of the —$SO_3M$ group-containing compound differs depending on the material to be treated, its structure, the kind and concentration of the pretreating agent, ink viscosity, etc., but that of the dispersing agent is 10 to 100% (based on dyestuff or pigment) and that of the water-soluble or water-dispersible polymer is 0 to 30 wt. % in ink.

In the ink composition of the present invention, —$OSO_3M$ and —$SO_3M$ groups are contained in a water-insoluble dyestuff or pigment as dispersant and polymer, respectively, and these contain similar functional groups, thus ensuring very good compatibility and stability of the dispersant and the polymer. This is also one of the features of the present invention.

As examples of the water-insoluble dyestuff or pigment referred to herein are mentioned disperse dyestuffs, vat dyestuffs and pigments. Its concentration is usually in the range of 0.01 to 20 wt. %, and the average particle size of the water-insoluble dyestuff or pigment ink is not larger than 1μ, preferably not larger than 0.5μ. The smaller the particle size, the more improved the dyestuff absorbability or dispersion stability.

The typical ink compositions containing the water-insoluble dyestuff or pigment are as follows:

| | Ink Composition | | |
|---|---|---|---|
| | a wt. % | b wt. % | c wt. % |
| Dyestuff or pigment | 5–15 | 5–15 | 5–15 |
| Dispersant of the present invention[1] | 1.5–4.5 | 1.5–4.5 | — |
| Conventional dispersant | — | — | 1.5–4.5 |
| $SO_3M$ group-containing polymer of the present invention[2] | — | 2–5 | 4–10 |
| Anti-drying component[3] | 10–40 | 10–40 | 10–40 |
| Others | balance | balance | balance |

[1]Tri-α-methyl-benzyl-phenol E O adduct-sulfates

[2]Water-dispersible copolyester

[3]Polyhydric alcohol such as ethylene glycol, propylene glycol

On the other hand, as a preferred example of a water-soluble dyestuff composition is mentioned an ink composition which contains a water-soluble dyestuff and a water-soluble or water-dispersible polymer containing —$SO_3M$ group. Water-soluble dyestuffs generally contain —$SO_3M$ group as a hydrophilic group, so the dyestuffs per se somewhat exhibit a coagulating action against fabrics pretreated with metallic salts or cationic substances. However, this phenomenon renders the dyestuffs per se insoluble, causes loss of ionic property of the functional groups required for exhaustion, thus resulting in decrease of the bonding force thereof with hydrophilic fibers and a marked reduction of dyeing affinity.

To remedy such drawbacks, the present invention provides an ink composition containing a water-soluble dyestuff and a —$SO_3M$ group-containing polymer incorporated therein, the polymer being allowed to coagulate while suppressing the coagulation of the dyestuff to a great extent to prevent the deterioration of dyeability.

The amount of the water-soluble or water-dispersible polymer containing —$SO_3M$ group is in the range of 1 to 20 wt. %. If its amount is less than 1 wt. %, there will occur coagulation of the water-soluble dyestuff and reduction of the dyeing affinity will result. And if it exceeds 20 wt. %, the water-soluble dyestuff will become less soluble. A preferable range is from 3 to 10 wt. %.

Particularly preferred water-soluble dyestuffs are reactive dyestuffs whose reacting groups with fiber are not —$SO_3M$. More particularly, in the case where an ink comprising a reactive dyestuff is applied to a fabric pretreated with the material (B), the functional groups which participate in the reaction and fixing do not undergo changes even the —$SO_3M$ group as a hydrophilic group somewhat replaces the pretreating agent, and so there will be little reduction of dyeability.

Examples of the water-soluble dyestuff referred to herein include anionic water-soluble dyestuffs such as acid dyestuffs, metal complexed acid dyestuffs, direct dyestuffs, reactive dyestuffs and complexed cationic dyestuffs with anionic compounds. The amount of the water-soluble dyestuff is preferably in the range of 0.5 to 25 wt. %.

Both the water-insoluble dyestuff or pigment and water-soluble dyestuff ink compositions consist principally of the foregoing ink composition components. In addition, they contain preferably 5 to 60 wt. % of a high boiling water-soluble solvent as an anti-drying component. Examples are polyhydric alcohols such as ethylene glycol, diethylene glycol, thiodiethylene glycol, triethylene glycol, butane diol, hexylene glycol, polyethylene glycol, glycerin and propylene glycol, polyhydric alcohol monoethers such as ethylene glycol monomethyl ether and diethylene glycol monoethyl ether, dimethylformamide and N-methyl-2-pyrrolidone.

In addition, the compositions may contain a physical property adjusting agent (adjustment of viscosity, surface tension, electric conductivity and pH), an antiseptic, a sterilizing agent, an oxygen absorber and a chelating agent.

The ink viscosity is very important in the ink jet dyeing process. The lower the ink viscosity, the more improved the injection characteristic. It is not higher than 30 cP, preferably not higher than 10 cP. As to the surface tension, a preferable range is from 40 to 60 dyne/cm.

After application of droplets to a substrate pretreated with the material (B), using the ink composition of the present invention, according to the ink jet or spray dyeing process, there is performed a conventional color developing (fixing) treatment using dry or wet heat. Subsequently, a soaping step may be added for the purpose of improving color fastness and touch.

Examples of the material to be treated in the invention include non-permeable materials such as films, but preferably include absorbable fiber structures such as paper, knitted and woven fabrics and non-woven fabric.

According to present inventors' study, in the conventional ink jet process, ink is low in viscosity so diffuses into the fabric interior, giving a whitish and thin surface appearance of the fabric, while in the present invention, such internal diffusion is somewhat suppressed, so the surface color density looks high and the colored portion becomes more uniform.

Thus, if an appropriate pretreatment is made using the ink composition of the present invention, sharp patterns can be drawn on various knitted and woven fabrics including thin to thick fabrics without substantial deterioration of the injection characteristic in the ink jet process. And it becomes possible to print delicate patterns equal or even superior to conventional prints.

The present invention has been described mainly about ink jet dyeing, but it is to be understood that the present invention is applicable also to spray dyeing and to the case where various treating agents are used for other purposes than coloring.

The following examples are given to further illustrate the present invention, but the invention is not limited thereto.

EXAMPLE 1

Fabric (weave: Palace, weight: 80 g/m$^2$) comprising polyester fiber was pretreated (1) with the following metallic salts, and the fabric thus pretreated was subjected to ink jet dyeing (3) using disperse dyestuff ink compositions (2).

(1) Pretreatment (a) Calcium chloride ($CaCl_2.2H_2O$) 20, 50 g/l (b) Barium chloride ($BaCl_2.2H_2O$) 20, 50 g/l Padding (wet pickup: 40%), Drying (100° C.×5 minutes)

(2) Disperse Dyestuff Ink Composition

The following two kinds of dispersing agents were added 50% (based on dyestuff) to 10% stock of CI Disperse Red 92 as a disperse dyestuff and ion-exchanged water was added to make up to 100 cc. Then, 100 cc glaass beads (1 mm dia) were added and then dispersed for 30 minutes by means of a said grinder. Then, the dispersion was filtered with a 5μ cut filter. Dispersing Agent (c) Anionic Type: formula (6)

Tri-α-methyl-benzyl-phenol-$(EO)_7SO_3NH(C_2H_4OH)_3$ (d) Pluronic (Nonionic) Type $HO(C_2H_4O)_{140}(C_3H_6O)_{54}(C_2H_4O)_{140}H$ Using this solution, inks of the following four compositions were prepared.

| | Dyeing Solution | | | |
|---|---|---|---|---|
| | INK A parts | INK B parts | INK C parts | INK D parts |
| Dispersing agent (c) | 50 | 50 | | |
| Dispersing agent (d) | | | 50 | 50 |
| Propylene glycol | 30 | 30 | 30 | 30 |
| Water-dispersible polyester resin (30%)* | | 20 | 20 | |
| Ion-exchanged water | 20 | | | 20 |
| Viscosity (cP) | 2.3 | 3.1 | 3.0 | 2.7 |

*The composition of the water-dispersible polyester resin is as follows:
Isophthalic acid 90 mol %
Sodium sulfoisophthalate 10 mol %
Diethylene glycol 100 mol %
Molecular weight: about 10,000

The viscosity was measrued at 35° C., 100 rpm, using an E type viscosimeter.

| (3) Ink Jet Dyeing | |
|---|---|
| Ink jet process | on demand type |
| Nozzle diameter | 60μ |
| Nozzle-fabric distance | 1 mm |
| Applied voltage | 40 V |
| Resolution | 8 dots/mm |

After applicaiton of ink by ink jet, a fixing treatment was performed for 10 minutes using superheated steam (180° C.), followed by reduction cleaning by a conventional method.

Dot diameters of the dyed products, observed through a microscope, and the color developability are as set out in Table 1 in terms of long diameters and L values, respectively.

The following INK A, B and C are ink composition of the present invention.

INK A: Dispersant . . . —$SO_3M$ group
INK B: Dispersant . . . —$SO_3M$ group

-continued

| | |
|---|---|
| | Water dispersibility . . . —$SO_3M$ group containing resin |
| INK C: | Water dispersibility . . . —$SO_3M$ group containing resin |

INK D does not contain the —$SO_3M$ group of the present invention. For the pretreatment in the present invention there were used calcium and barium chlorides.

From the results of Table 1 it is seen that the fabrics pretreated with the metallic salts using the ink compositions of the present invention are not larger than 300μ in dot diameter and afforded very clear patterns, and that the color developability is remarkably improved because the ink coagulates on the fabric surface and is thereby prevented from premeating into the fabric.

TABLE 1

| Pretreatment of fabric | | Dot Diameter (μ) INK A | INK B | INK C | INK D | *Color Value (L value) INK A | INK B | INK C | INK D |
|---|---|---|---|---|---|---|---|---|---|
| No pretreated | | 600 | 580 | 590 | 620 | 45.1 | 45.0 | 45.0 | 46.2 |
| Calcium chloride ($CaCl_2.2H_2O$) | 20% | 280 | 260 | 270 | 580 | 37.4 | 37.2 | 37.3 | 44.0 |
| | 50% | 250 | 210 | 220 | 560 | 35.0 | 34.2 | 34.3 | 43.8 |
| Barium chloride ($BaCl_2.2H_2O$) | 20% | 240 | 200 | 210 | 560 | 34.5 | 34.0 | 34.2 | 43.8 |
| | 50% | 200 | 180 | 200 | 540 | 33.9 | 33.5 | 34.1 | 43.0 |

present invention

*The lower L-value means deeper shade.

EXAMPLE 2

In order to check whether the bleeding preventing method of the present invention is applicable to a wide variety of knittings and fabrics, polyester knittings and fabrics having different bleeding characteristics were treated in about the same manner as in Example 1.

(1) Pretreatment (a) Calcium chloride ($CaCl_2.2H_2O$) 20 g/l (b) Barium chloride ($BaCl_2.2H_2O$) 20 g/l (2) Ink Composition Treatment was made in the same way as in Example 1 except INK B used therein. Dot diameters are as set out in Table 2. From the results set forth in Table 2 it is seen that the products obtained using the ink compositions of the invention after pretreatment according to the method of the invention are reduced in dot diameter, about one third even in Taffeta and Tricot which exhibit the largest bleeding, and have sharp patterns.

TABLE 2

| | Dot diameter: Dot diameter (μ): Type of fabric: Taffeta (FY) | Tropical (SF) | Broad (SF) | Tricot (FY.K) | |
|---|---|---|---|---|---|
| | Weight ($g/m^2$) | | | | |
| Pretreatment | 60 | 70 | 130 | 90 | Note |
| Not pretreated (blank) | 900 | 700 | 800 | 850 | Comparison |
| Pretreated $CaCl_2.2H_2O$ | 300 | 260 | 280 | 290 | Present Invention |
| Pretreated | 270 | 240 | 250 | 270 | Present |

TABLE 2-continued

| | Dot diameter: Dot diameter (μ): Type of fabric: Taffeta (FY) | Tropical (SF) | Broad (SF) | Tricot (FY.K) | |
|---|---|---|---|---|---|
| | Weight ($g/m^2$) | | | | |
| Pretreatment | 60 | 70 | 130 | 90 | Note |
| $BaCl_2.2H_2O$ | | | | | Invention |

FY: filament yarn fabric
SF: spun fabric
FY.K: filament yarn knitting

EXAMPLE 3

Polyester 65/Cotton 35 blended fabric (weave: Broadcloth) comprising polyester fiber and cotton was padded with 20 g/l of barium chloride and then dried to obtain a pretreated fabric. Then, a dispersing treatment was performed in the same way as in Example 1 by adding 30% (based on pigment) of a compound of the dispersant formula (2) [distyrenized phenol $(EO)_{1-0}SO_3NH_4$] to 10% CI Pigment 15:3. Then, the following ink composition was prepared:

| | |
|---|---|
| CI Pigment Blue 15:3 (10%) | 30 parts |
| Glycerin | 20 parts |
| Primal E-32 (Acrylic emulsion, a product of Rohm & Haas Co.) | 20 parts |
| Ion-exchanged water | 10 parts |

After ink application, a fixing treatment was performed by dry heat at 150° C. for 3 minutes. Other treating conditions were the same as in Example 1. Dot diameter and color developability (L value) were measured as shown in Table 3.

Reference to the results of Table 3 it is seen that also in the use of pigment the treated product of the invention is small in dot diameter, prevented from bleeding and has a sharp pattern.

TABLE 3

| Pretreatment | Dot diameter (μ) | Color Value (L value) | Note |
|---|---|---|---|
| Not pretreated (blank) | 480 | 46.1 | Comparison |
| Pretreated ($BaCl_2.2H_2O$) | 220 | 39.3 | Present Invention |

EXAMPLE 4

Cotton 100% fabric (weave: Broadcloth) was pretreated with 50 g/l of calcium acetate by Pad.Dry method (w.p.u. 70%).

The following reactive dyestuff ink compositions of three primary colors were prepared:

| | |
|---|---|
| Reactive dyestuff* | 8 parts |
| Thiodiethylene glycol | 20 parts |
| Diethylene glycol | 10 parts |
| Water-dispersible polyester resin** | 20 parts |
| Ion-exchanged water | 42 parts |

*Yellow: CI Reactive Yellow 25
Red: CI Reactive Red 40
Blue: CI Reactive Blue 29
**Dimethylphthalic acid 30 mol %
Isophthalic acid 30 mol %
Sodium sulfoisophthalate 40 mol %
Ethylene glycol 100 mol %

By way of comparison, there was prepared an ink composition not containing a water-dispersible polyester resin. After ink jet in the same way as in Example 1, a fixing treatment was performed under wet heat of 100° C. for 30 minutes.

Flower patterns were printed using the above three primary color inks. The fabrics pretreated and printed using the water-dispersible polyester resin-containing inks of the invention had clear patterns of dark color. On the other hand, the fabric printed with ink not containing such water-dispersible polyester resin exhibited a large bleeding in blended color portions due to overlapping of dots, and thus was not practical.

EXAMPLE 5

Crepe for Japanese dress comprising silk fabric was pretreated (1) with the following pretreating agent and then dyed by ink jet using an acid dyestuff ink (2).

(1) Pretreatment

Calcium chloride ($CaCl_2.2H_2O$) 50 g/l (2) Acid dyestuff ink composition

| | INK E | INK F |
|---|---|---|
| CI Acid Blue 62 | 2 parts | 2 parts |
| Glycerin | 20 parts | 20 parts |
| Thiodiethylene glycol | 5 parts | 5 parts |
| Water-dispersible polyester resin* (25% concentration) | 10 parts | 40 parts |
| Ion-exchanged water | 63 parts | 33 parts |
| | 100 parts | 100 parts |

*The composition of the water-dispersible polyester resin is as follows:
Isophthalic acid 50 mol %
Terephthalic acid 25 mol %
Hexahydroisophthalic acid 15 mol %
Sodium sulfoisophthalate 10 mol %
Diethylene glycol 100 mol %
Molecular weight: about 7,000

The viscosity of INK E and that of INK F were 6.5 and 7.0 cP, respectively.

Ink jet dyeing and fixing treatment were performed in the same manners as in Examples 1 and 4. Dot diameters were measured as shown in Table 4.

Also with the acid dyestuff, there were attained bleeding preventing effect and clear pattern like the use of the water-insoluble dyestuffs (Examples 1, 2 and 3).

TAIBLE 4

| Pretreatment of fabric | Dot diameter (μ) INK E | INK F | Note |
|---|---|---|---|
| Not pretreated (blank) | 850 | 850 | Comparison |
| Pretreated ($CaCl_2.2H_2O$) | 300 | 200 | Present Invention |

What is claimed is:

1. A method for treating fabrics comprising pretreating a fabirc with a mateiral (B), said material (B) selected from the group consisting of a soluble salt of barium, calcium or potassium and a cationic compound selected from the group consisting of polyamines, amine salts and quaternary ammonium salts and applying, by ink jet or spray, a treating solution to said pretreated fabric whereby said material (B) is coagulated, said treating solution containing water, a water-insoluble dyestuff or pigment and a material (A), said material (A) selected from the group consisting of a copolyester and a dispersant, said copolyester having a molecular weight of 2,000 to 10,000 formed by the copolymerization of a dicarboxylic acid, said dicarboxylic acid selected from the group consisting of terephthalic acid, isophthalic acid and mixtures thereof, a diol, said diol selected from the group consisting of ethylene glycol, diethylene glycol, butylene glycol and mixtures thereof and a bifunctional monomer, said bifunctional monomer selected from the group consisting of sodium salts of sulfoisophthalic acid, sodium salts of sulfoterephthalic acid, sodium salts of sulfophthalic acid and sodium salts of 4-sulfonaphthalene-2,7-dicarboxylic acid, said dispersnat havign a molecular weight of 350 to less than 2,000, represented by the formula

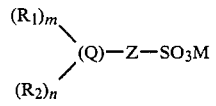

where Q is at least one aromatic ring, said aromatic ring selected from the group consisting of a benzene ring and a naphthalene ring; $R_1$ is an aromatic ring-containing group; $R_2$ is lower alkyl or halogen; Z is a divalent alkylene ether or a derivative thereof; M is ammonium, amine or a monovalent metal; m is an integer of 2 to 5; and n is 0 or an integer of 1 to 3.

2. A method in accordance with claim 1 wherein said material (B) includes an anion selected from the group consisistng of a halide, a nitrate and an acetate.

3. A method accordance with claim 1 wherein the fabric is at least one member selected from the group consisting of woven fabrics, knitted fabrics and non-woven fabrics.

* * * * *